United States Patent [19]

Tawara et al.

[11] Patent Number: 4,678,634

[45] Date of Patent: Jul. 7, 1987

[54] METHOD FOR THE PREPARATION OF AN ANISOTROPIC SINTERED PERMANENT MAGNET

[75] Inventors: Yoshio Tawara; Ken Ohashi, both of Fukui, Japan

[73] Assignee: Shin-Etsu Chemical Co., Ltd., Tokyo, Japan

[21] Appl. No.: 851,529

[22] Filed: Apr. 14, 1986

[30] Foreign Application Priority Data

Apr. 18, 1985 [JP] Japan ..... 60-83524
Apr. 18, 1985 [JP] Japan ..... 60-83525

[51] Int. Cl.[4] ..... B22F 1/00

[52] U.S. Cl. ..... 419/30; 148/103; 148/108; 29/DIG. 95; 335/296; 335/302; 419/38; 419/62; 419/66; 420/416

[58] Field of Search ..... 335/296, 302; 75/122.1; 29/DIG. 95; 148/103, 108; 419/30, 38, 62, 66

[56] References Cited

U.S. PATENT DOCUMENTS 4,431,604 2/1984 Sata et al. ..... 419/26

4,600,555 7/1986 Shimizu ..... 419/5

*Primary Examiner*—Stephen J. Lechert, Jr.

*Attorney, Agent, or Firm*—Wenderoth, Lind & Ponack

[57] ABSTRACT

Method of preparing an anisotropic permanent magnet by a powder metallurgical technique, in which, the step of orientation of anisotropically magnetic particles during shaping by compression to give a green body prior to sintering, the magnetic field is applied pulse-wise to the mass of magnetic particles and an impacting compressive force is applied to the thus oriented particles in the direction parallel to the magnetic field during the period in which a pulse of the pulse-wise magnetic field is sustained. This method ensures a much higher degree of particle orientation than in the conventional static-field method by virtue of the possibility of obtaining a much stronger magnetic field without problems which otherwise are unavoidable. The principle of the method is applicable to the preparation of a cylindrical or annular permanent magnet magnetizable in a plurality of radial directions.

10 Claims, 17 Drawing Figures

METHOD FOR THE PREPARATION OF AN ANISOTROPIC SINTERED PERMANENT MAGNET

BACKGROUND OF THE INVENTION

The present invention relates to a method for the preparation of anisotropic permanent magnet by a powder metallurgical technique. More particularly, the present invention relates to a method for the preparation of an anisotropic permanent magnet including a step of shaping a magnetic powder into a form by compression in a magnetic field to orient the magnetic particles, in which the magnetic particles can be oriented more completely within a greatly decreased time than in the conventional method.

It is a conventional process in the method for the preparation of an anisotropic permanent magnet by a powder metallurgical technique that particles of a magnetic alloy powder are oriented relative to the easy magnetization axis of the crystallites in a magnetic field using an electromagnet and then shaped by compression in a molding die followed by sintering. Such a process of molding is referred to as a process of field pressing hereinbelow. The magnetic field in conventional field pressing processes is of course static and usually has a strength of a few kOe to 10 kOe in most cases. A problem in this case is the incompleteness of the particle orientation for several reasons, and orientation of particles in the powder compact cannot be so complete as in a single crystal. Several of the reasons therefor include the difficulty in obtaining a sufficiently strong magnetic field, imperfect parallelism of the magnetic field, uneven compressive force on the powder compact in the compression shaping, non-uniformity in the impregnation of the molding die with the magnetic powder and so on.

The field pressing processes can be classified into two classes relative to the directions of the magnetic field and the compressive force. Namely, the direction of the magnetic field can be perpendicular to or parallel with the direction of the compressive force. It is usually understood that the latter method of powder compression in a direction parallel to the direction of the magnetic field, which is referred to as the parallel-field pressing hereinbelow, is less preferable, because of the disturbed orientation of the particles, than the former method, referred to as the transverse-field pressing hereinbelow, in which the oriented magnetic particles are compressed perpendicularly to the direction of the magnetic field. For example, a rare earth-cobalt magnet prepared by the parallel-field pressing has a saturation magnetization $4\pi M_z$ as a measure of the particle orientation lower by almost 10% than the magnet of the same rare earth-cobalt alloy prepared by the transverse-field pressing.

Although the degree of particle orientation can be improved by increasing the uniformity of the compressive force, use of a press with static hydraulic pressure such as a so-called rubber press is not always practical due to the unduly long time taken for a shot of molding and the difficulty in the design of the press by combining the press with an electromagnet built in. The degree of particle orientation can of course be improved by increasing the strength of the static magnetic field in the field pressing to several tens of kOe or higher. While a conventional electromagnet can produce a static magnetic field of up to 10 kOe in a space of a 10 to 100 mm gap, it is an extremely difficult matter to obtain a still stronger static magnetic field without using a superconducting magnet or a solenoid coil of normal conduction, but they are far from practical as an industrial means due to the expense of the apparatus, high costs for maintenance and low operability. Accordingly, it has been eagerly desired to develop a method for obtaining a high degree of orientation of magnetic particles, without the problems associated with the powder metallurgical method, for the preparation of an anisotropic permanent magnet.

Separately from the above described problems, to the prior art also includes preparation of an anisotropic permanent magnet in which the magnetic particles are oriented radially or in a plural number of radial directions. In the field pressing using a hydraulic press, for example, the molding die filled with the magnetic particles is surrounded by an electromagnet having a plurality of poles so as to realize the above mentioned particle orientation in a plurality of radial directions. Alternatively, magnet poles of the same polarity are oppositely disposed so as to obtain the radial orientation of the magnetic particles by utilizing the repulsion of the magnetic fields. These methods have several disadvantages such that the electromagnet is necessarily very large with low versatility in respect of the number of poles, and that such an electromagnet usually cannot produce a sufficiently strong magnetic field essential for obtaining a high degree of particle orientation.

In the injection molding of a plastic magnet, on the other hand, the orientation of the magnetic particles can be considerably high even without applying a particularly strong magnetic field because a mixture of magnetic particles and a molten binder resin is injected under a shearing force into a molding die. Of course, the performance of a plastic magnet inherently can never be so high as that of a sintered permanent magnet prepared by the powder metallurgical techniques because a plastic magnet comprises the non-magnetic binder resin in a considerably high volume fraction. For example, the maximum energy product $(BH)_{max}$ of a plastic magnet composed of a magnetic powder and a binder resin in a volume ratio of 70:30 is sometimes only about 50% or even smaller compared to that of the sintered magnet prepared of the same magnetic powder. In the conventional design of magnets, accordingly, isotropic magnets are used in place of the above described radially oriented anisotropic permanent magnets notwithstanding the much lower values of the magnetic parameters than the anisotropic magnets, including about a half of the residual magnetization $B_r$ and about one fourth of the maximum energy product $(BH)_{max}$.

SUMMARY OF THE INVENTION

It is therefore an object of the present invention to provide a method for the preparation of an anisotropic permanent magnet in the powder metallurgical process in which a greatly improved orientation of the magnetic particles can be obtained within a relatively short time without the above described problems and disadvantages in the conventional methods of the prior art.

Another object of the invention is to provide an efficient method for the preparation of an anisotropic permanent magnet, which method is applicable even to a magnet prepared of magnetic particles oriented in a plurality of radial directions.

The inventive method consists in the application of a magnetic field in a pulse-wise manner to a mass of fine particles of an anisotropic magnetic powder so as to orient the magnetic particles to have the easy magnetization axes thereof aligned in the direction of the magnetic field, and compressing the magnetic particles into a form by applying a compressive force in a pulse-wise or impacting manner during the period in which the pulse-wise magnetic field is sustained, the direction of the compressive force being parallel to the direction of the magnetic field.

The above described principle of the pulse-wise field pressing during the period of the sustained pulse-wise magnetic field is applicable to the preparation of a cylindrical or annular permanent magnet of which the particle orientation and magnetization is in a plural and even number of the radial directions.

FIGS. *2a* and *2b* are each an explanatory graph showing the timing relationship between the pulse-wise magnetic field and the impacting compressive force.

Figure 3:
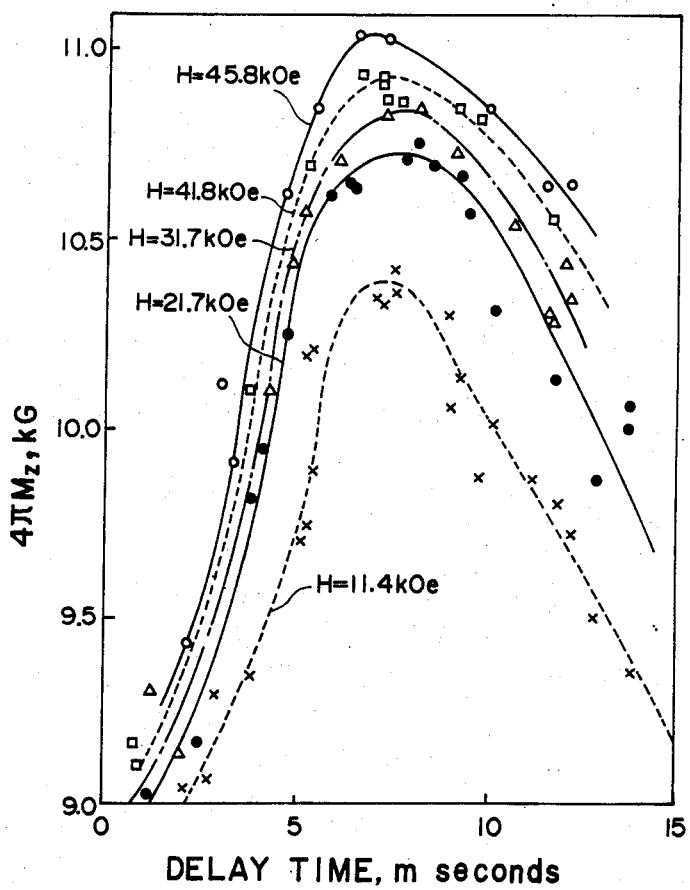

FIG. 3 is an explanatory graph showing the saturation magnetization $4\pi M_z$as a function of the delay time with varied magnetic fields for particle orientation.

Figure 4:
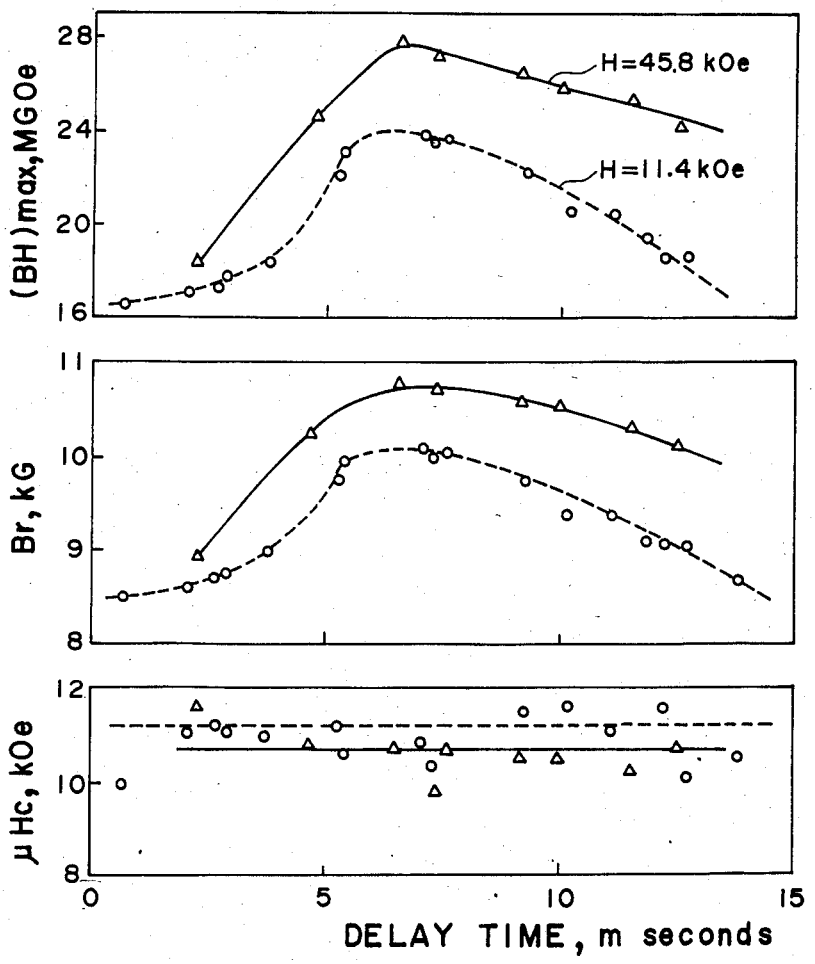

FIG. 4 includes graphs showing the magnetic properties of the permanent magnets prepared under the conditions of FIG. 3 as a function of the delay time.

Figure 5:
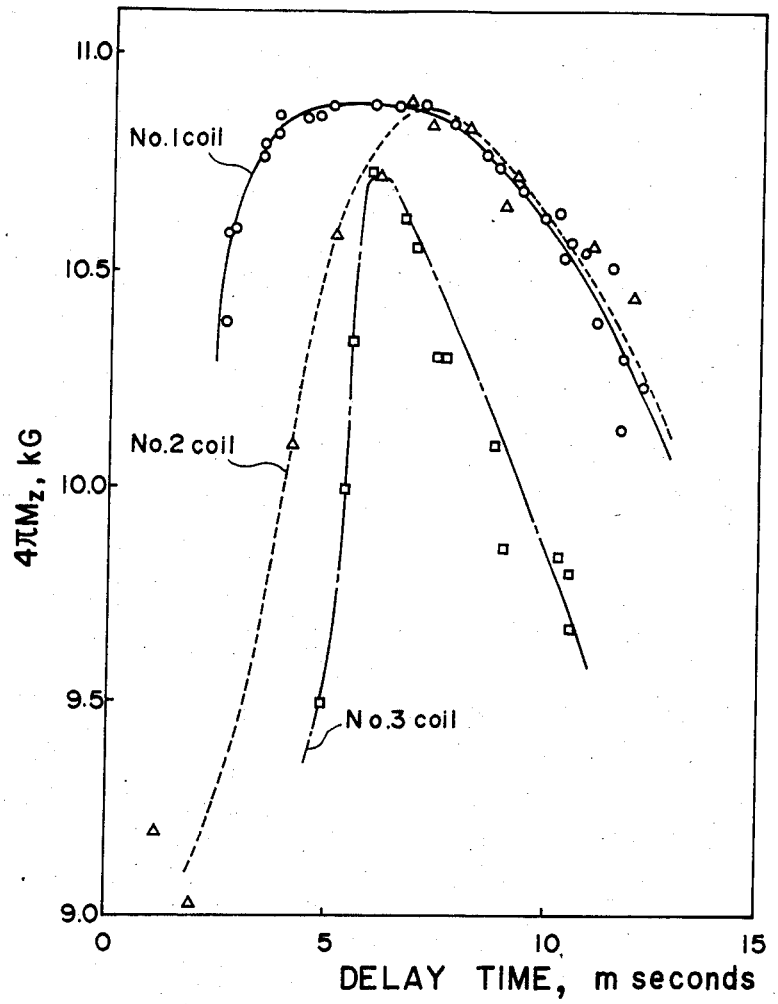

FIG. 5 is a graph showing the saturation magnetization $4\pi Mz$ of the permanent magnets prepared by using coils having different rising times of the magnetic field as a function of the delay time.

Figure 6:
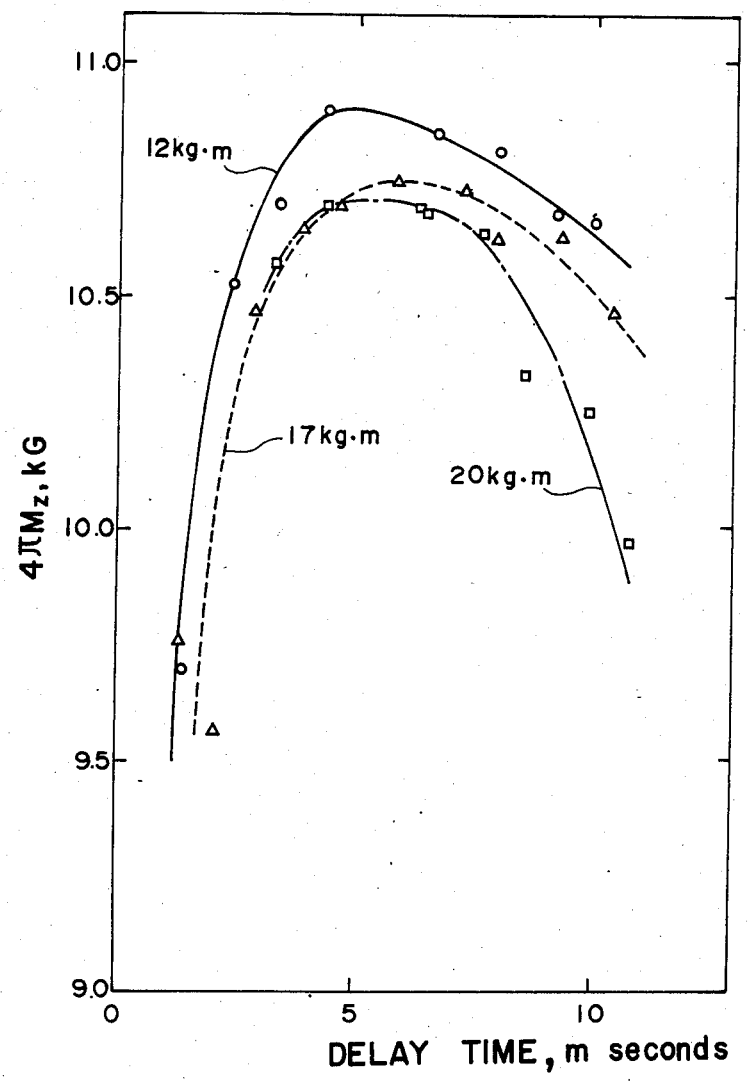
Figure 7A:
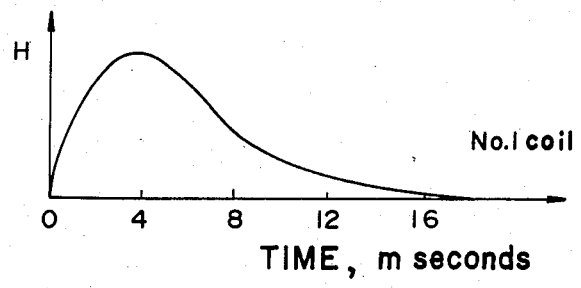
Figure 7B:
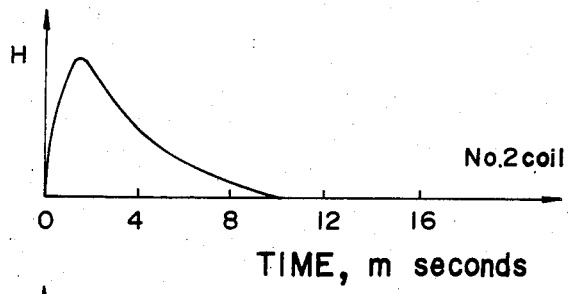
Figure 7C:
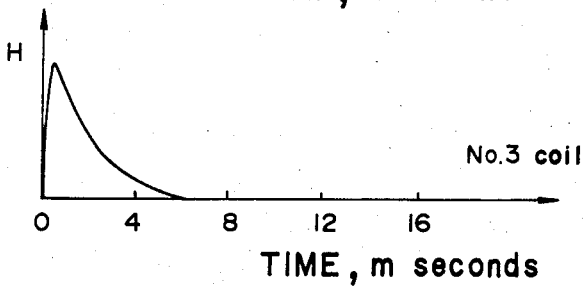

FIG. 6 is a graph showing the saturation magnetization $4\pi M_z$of permanent magnets prepared by compression with application of different pulse-wise compressive forces and the wave form of the impacting compressive forces as a function of the delay time.

FIGS. *7a, 7b* and *7c* are each a graph showing the pulse-wise wave form of the magnetic field generated with a different coil.

Figure 8:
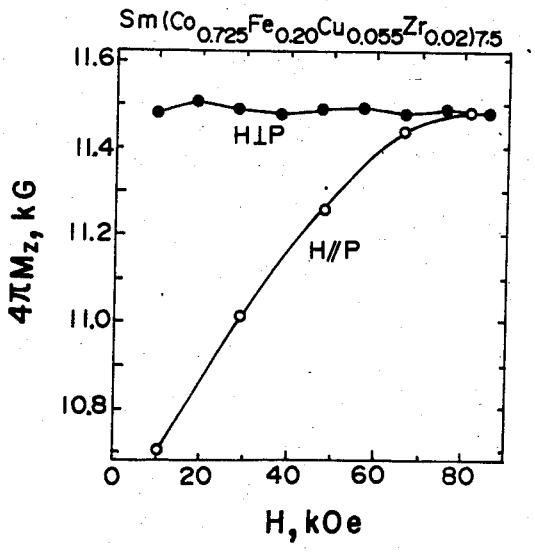

FIG. 8 is a graph showing the saturation magnetization $4\pi M_z$ of the permanent magnets prepared by the parallel-field pressing and transverse-field pressing as a function of the static magnetic field for particle orientation.

Figure 9:
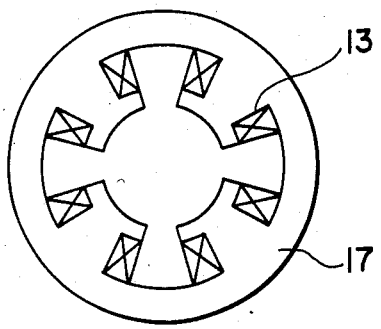

FIG. 9 is a schematic plan view of a four-polar electromagnet used for the particle orientation in four radial directions according to the invention.

Figure 10:
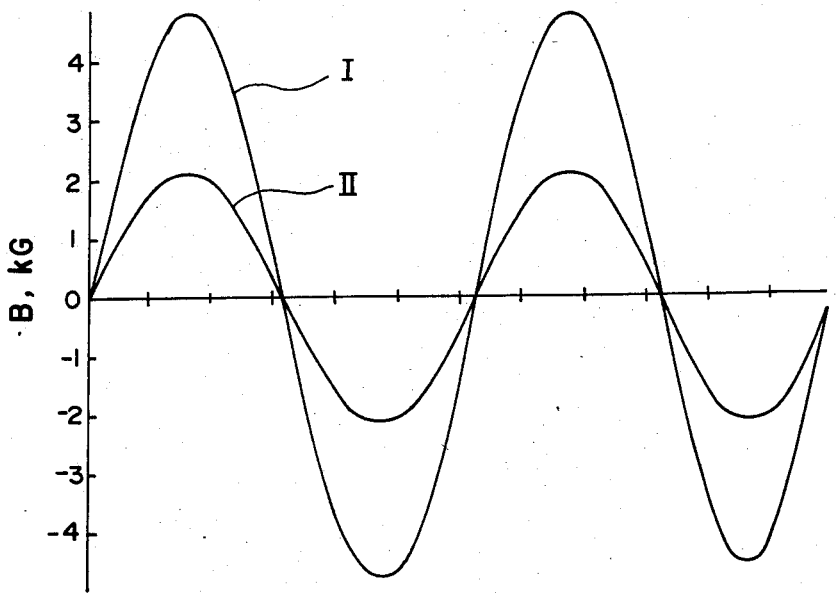
Figure 11:
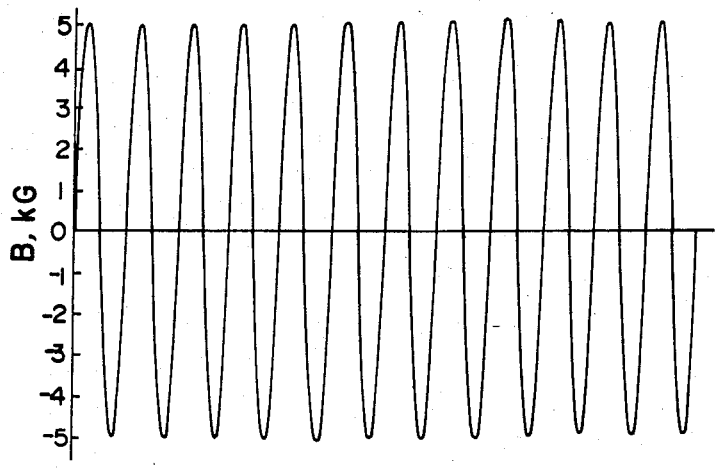

FIGS. 10 and 11 are each a graph showing the open-flux value along the outer periphery of an anisotropic sintered samarium-cobalt permanent magnet prepared by the 4-polar or 24-polar radial particle orientation, respectively.

Figure 12:
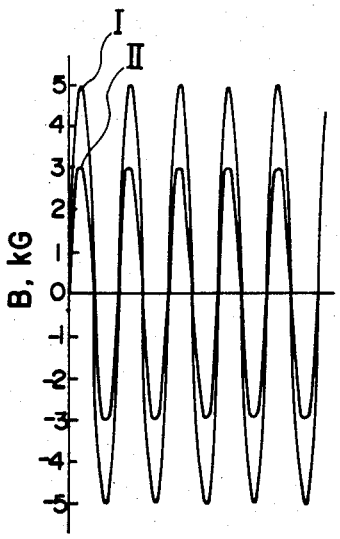

FIG. 12 is a graph comparatively showing the open-flux values along the outer periphery of a powder-metallurgically sintered magnet and a plastic magnet of a samarium-cobalt alloy, each with 24-polar radial particle orientation.

Figure 13:
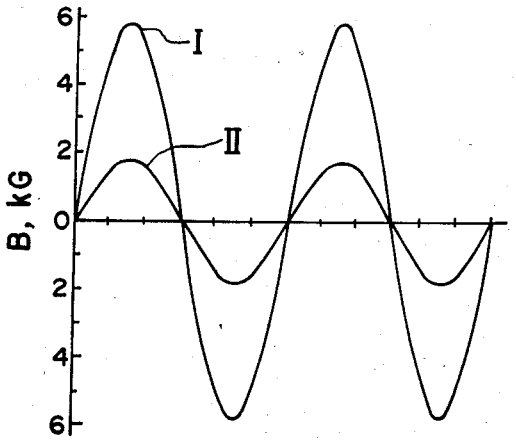

FIG. 13 is a graph comparatively showing the open-flux values along the outer periphery of a neodymium magnet and a barium ferrite magnet, each with 4-polar radial particle orientation.

Figure 14:
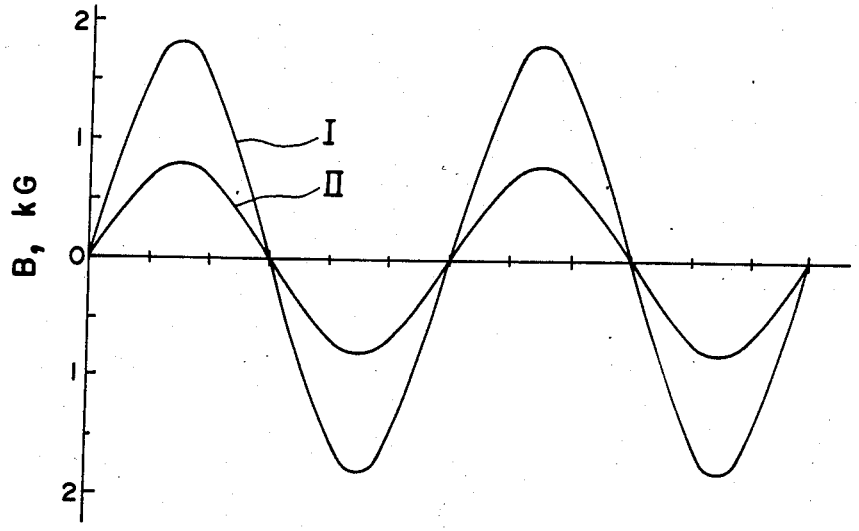

FIG. 14 is a graph comparatively showing the open-flux values along the outer periphery of a powder-metallurgically sintered barium ferrite magnet with 4-polar radial particle orientation, and an isotropic sintered barium ferrite magnet.

DETAILED DESCRIPTION OF THE PREFERRED EMBODIMENTS

As is mentioned above, the conventional field pressing of an anisotropic magnet powder is performed, without exception, in a static field using an electromagnet under compression by a quasi-static compressive force using a hydraulic press. The inventors have conducted extensive investigations with an object to obtain a high degree of particle orientation using such a static magnetic field for the transverse-field pressing and parallel-field pressing. As a result, it has been concluded that the saturation magnetization $4\pi M_z$ of the sintered permanent magnets greatly increases with the increase in the strength of the magnetic field, especially, when the method of parallel-field pressing is undertaken as is shown in FIG. 8 in which the curves indicated by $H \parallel P$ and $H \perp P$ are for the parallel-field pressing and transverse-field pressing, respectively, for the specified samarium-cobalt based magnet powder. These results provided the basic idea leading to the present invention by seeking a means to obtain a greatly increased magnetic field for particle orientation in the process of parallel-field pressing. Namely, the principle of the inventive method is a combination of a pulse-wise magnetic field, which can be much stronger even by use of a relatively inexpensive instrumentation than static magnetic fields, and a pulse-wise or impacting compressive force which is applied to the magnetic particles during the pulse period in which the magnetic field is sustained.

Figure 1:
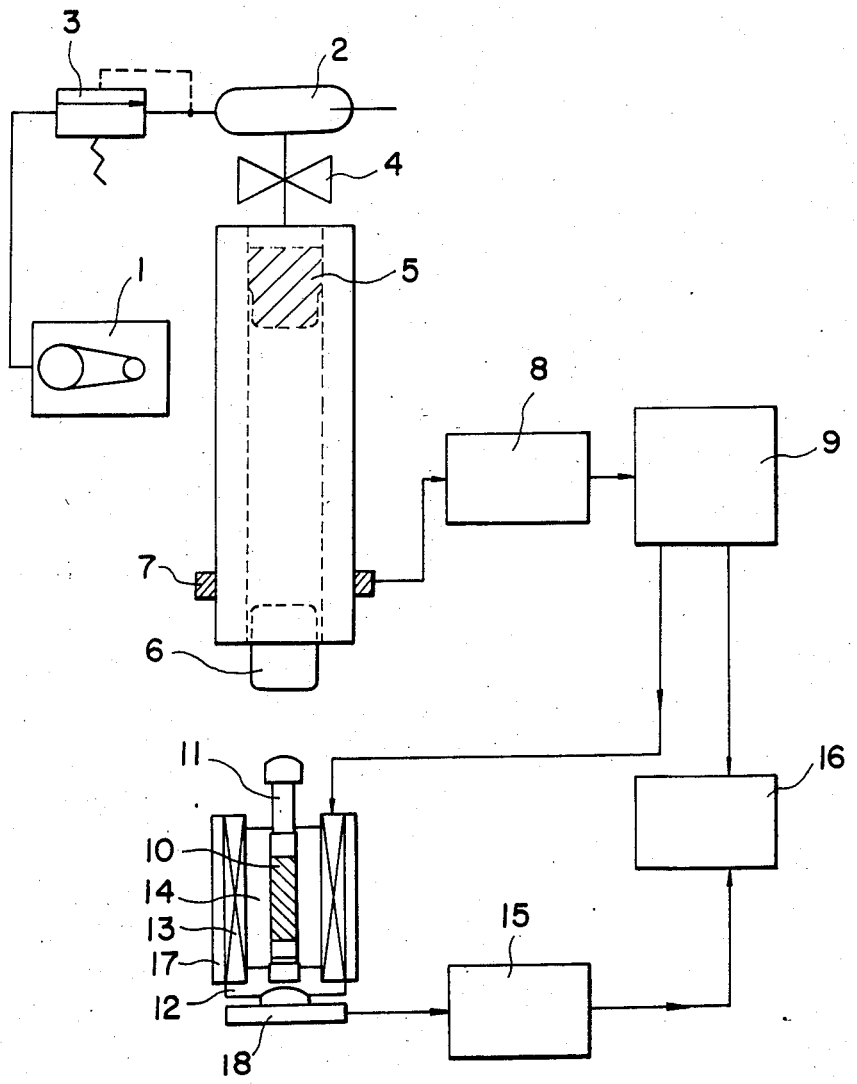
FIG. 1 is a diagrammatic illustration of an apparatus used in practicing in the inventive method.

FIG. 1 of the accompanying drawings schematically illustrates the apparatus used for practicing the inventive method of field pressing in which a strong pulse-wise magnetic field is generated and applied to the magnet powder which is compressed by a pulse-wise or impacting compressive force. In this apparatus, the compressive force is pneumatically produced pulse-wise by releasing high pressure air in air reservoir 2 compressed and stored under a controlled pressure by means of a compressor 1 through a reducing valve 3 by suddenly opening the solenoid valve 4 so that upper hammer 5 is accelerated by the air impact and hits the lower hammer 6 at bottom of a cylinder with its body weight. The air pressure in the air reservoir 2 is usually in the range from 1 to 8 $kgf/cm^2$although the pressure should be increased when a higher compressive force is desired. The lower hammer 6 leaves the cylinder and hits upper punch 11 of molding die 14 filled with magnetic powder 10 to compact the powder 10 with lower punch 12. Thus, the pneumatic energy of the compressed air is transduced into the energy for the compression of the magnetic powder 10 in an impacting manner.

Solenoid covered by outer cover 17 is excited by electric power coil 13 obtained by the discharge of a capacitor which is triggered when the dropping upper hammer 5 traverses the light beam emitted from and detected in photoelectric sensor system 7 generating a pulse signal to be inputted to delay pulser 8 which delayedly starts the pulse-wise discharge from powder source 9. The timing between the impact on the upper punch 11 by the dropping hammer 6 and the pulse-wise power discharge from the power source 9 can be controlled by means of the delay pulser 8 combined with strain gauge 18 below the the lower punch 12 of the molding die 14 connected to amplifier 15 and transient converter 16.

Figure 2A:
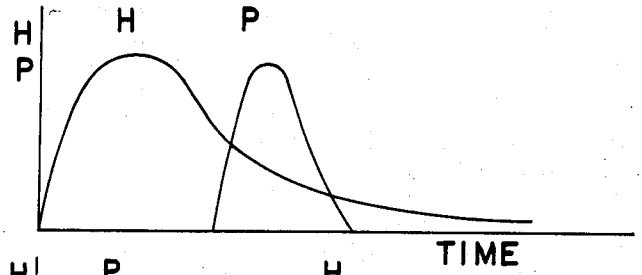
Figure 2B:
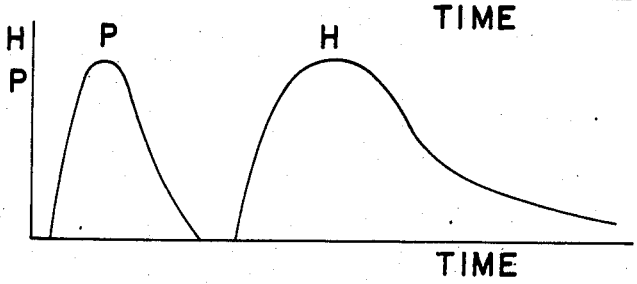

In the above described apparatus, the impact on the upper punch 11 of the molding die 14 is given by a combination of the upper and lower hammers 5, 6 but it is of course optional to use a single hammer. FIGS. 2*a* and 2*b* facilitate an explanation of the timing relationship between the impacting compressive force P and the pulse-wise magnetic field H by the solenoid coil. It is desirable, as is shown in FIG. 2*a*, that the compression by the impacting force is started and terminated within the period during which the magnetic field H is sustained. When the compression by the impacting compressive force P precedes the pulse-wise magnetic field H, as is shown in FIG. 2*b*, compression of the magnetic particles is completed before particle orientation takes place so that no anisotropic permanent magnet can be obtained. When the time interval from the moment of the peak value in the magnetic field H to the moment of the peak value of the impacting compressive force P is taken as the delay time D, the optimum value of the delay time D can easily be determined by several trials of pressing although the optimum delay time largely depends on the wave forms both of the pulse-wise magnetic field and the impacting force. The peak value of the pulse-wise magnetic field should desirably be at least 5 kOe in order to obtain full orientation of the magnetic particles.

The pulse width W of the magnetic field should be as small as possible from the standpoint of decreasing the energy consumption and consequent heat evolution in the solenoid coil, although the loss by the eddy current in the metal-made molding die surrounded by the coil would be unduly large to cause an effect of magnetic shielding when the pulse width W is extremely small. Larger pulse widths W of the magnetic field are of course preferable in view of the ease in obtaining good timing between the pulse-wise magnetic field and impacting compressive force, but increase in the pulse width necessarily requires a larger capacity and higher voltage of the power source so that the costs for the larger power source system are unavoidably increased in addition to the disadvantage of increased heat evolution in the coil. In this regard, the pulse width W of the magnetic field should be 1 second or smaller or, preferably, 0.5 second or smaller in order that the impacting compression for shaping is completed during the period of the sustained magnetic field. The pulse width W of the magnetic field also has a lower limit, on the other hand, for the reasons set forth above, in addition to another problem that the width or duration of the impacting compressive force should also be small enough to comply with the extremely small pulse width W of the magnetic field. However, such a decrease in the duration of the impacting compressive force can be obtained only by increasing the dropping velocity of the upper hammer which would be accompanied by possible disadvantages of eventual damage on the molding die and disturbance on the particle orientation. In this regard, the pulse width W of the magnetic field should be at least 1 μs (microsecond), preferably at least 0.01 millisecond. Although a single impacting compression is usually sufficient to achieve full orientation of the magnetic particles in the shaped body of the magnetic particles, it is of course optional to repeat of the impacting compression several times in pulses.

The rising time from the start to the peak of a pulse of the pulse-wise magnetic field is preferably in the range from 1 microsecond to 0.5 second, and the lasting duration of the impacting compressive force is preferably in the range from 1 microsecond to 0.5 second.

When the above described inventive method of compression shaping by impact under a pulse-wise magnetic field is undertaken, the resultant sintered permanent magnet may have a saturation magnetization $4\pi M_z$, as a measure of particle orientation, larger by up to 10% than the sintered permanent magnets of the same magnetic powder shaped by the conventional method under a static magnetic field, and an improvement of up to 20% can be obtained in the maximum energy product $(BH)_{max}$.

In addition to the above mentioned advantage in respect of the performance of the sintered permanent magnets, the inventive method is advantageous also in respect of the productivity since the process of field pressing is completed in one shot by virtue of the pulse-wise impression of the magnetic field and the compression by a single impact. For example, a single shot of the field pressing according to the invention is complete usually within a second while a shot of the conventional field pressing usually takes 10 to 20 seconds from the start of the impression of the magnetic field to the completion of demagnetization of the molded green body of the magnetic powder. Furthermore, the pneumatic hammer-driven press illustrated in FIG. 1 and described above is rather simpler in structure and less expensive than the conventional apparatuses using a hydraulic press.

The following description concerns the application of the above described field pressing by the combination of a pulse-wise magnetic field and impacting compressive force, to the preparation of a sintered permanent magnet in which the magnetic particles are oriented in plurality of radial directions.

FIG. 9 of the accompanying drawings is a schematic plan view of an electromagnet for 4-polar radial particle orientation. In FIG. 1, the molding die 14 filled with the magnetic powder 10 is surrounded by the solenoid coil 13 for particle orientation covered with an outer cover 17. As the advantages of the inventive method, the electromagnet for the magnetic circuit in FIG. 9 can be a relatively small one having coils wound on a small iron yoke because a large current is obtained by the discharge of a capacitor and a magnetic field of up to 100 kOe, and up to 20 kOe, respectively can easily be obtained with an air-core coil and an electromagnet having a magnetization yoke of iron core, and the magnetic circuit is versatile when the number of the poles in the magnet should be increased or decreased which can be performed by merely replacing the electromagnet. Thus, as a matter of course, the annular or cylindrical permanent magnets having a plural number of radial poles, as an anisotropic magnet, prepared by the inventive method can exhibit much higher performance than conventional anisotropic plastic magnets or isotropic magnets so that they are useful, for example, in stepping motors of which a greatly increased torque is required.

In the following, the method of the present invention is illustrated in more detail by way of examples.

EXAMPLE 1

A magnetic alloy of samarium, cobalt, iron, copper and zirconium in a predetermined formulation produced by melting in a high-frequency furnace was finely pulverized, using a jet mill, into a powder having an average particle diameter of 3 to 5 μm. A molding die is filled with the thus prepared magnetic powder and subjected to field pressing by impacting compression using the apparatus illustrated in FIG. 1 with adjustment of the timing between the pulse-wise generation of the magnetic field and the impacting compressive force by the pneumatic hammer.

The capacitor of 5 kV withstand voltage used for the electric discharge had a capacity of 800 $\mu$ F. The peak value of the pulse-wise magnetic field was varied from 10 to 45 kOe and the rising time to the peak of the magnetic field was 1.5 ms (milliseconds). The impacting compressive force was about 1 ton/cm$^2$ at the peak. The thus obtained green body of the magnetic powder was subjected to sintering in an insert atmosphere of argon for 1 hour at a temperature in the range from 1100° to 1200° C. followed by quenching. The saturation magnetization $4\pi M_z$ of these sintered bodies is shown in FIG. 3 as a function of the delay time D with the strength of the magnetic field as the variable parameter. FIG. 4 includes the graphs showing the magnetic properties of the magnets after thermal aging for 2 hours at 800° C. followed by gradual temperature decrease to 400° C. at a rate of 0.5° C./minute also as a function of the delay time. It is understood from these results that the saturation magnetization can be increased by increasing the magnetic field for particle orientation and optimum results can be obtained when the delay time is somewhere between 5 and 10 ms.

EXAMPLE 2

Shaped green bodies were prepared in a similar field pressing process to Example 1 using a magnetic powder of an alloy composed of neodymium, iron and boron, in which the peak value of the magnetic field for particle orientation was varied from 10 to 50 kOe. The green bodies were subjected to sintering in an inert atmosphere for 1 hour at a temperature in the range from 1000° to 1100° C. followed by quenching to room temperature and then subjected to thermal aging by keeping them at 500° C. for 1 hour followed by quenching. Tables 1 and 2 below show the saturation magnetization $4\pi M_z$of the magnetic bodies as sintered and the magnetic properties, i.e. saturation magnetization $4\pi M_z$, residual magnetization $B_r$, intrinsic coercive force ${}_iH_c$and maximum energy product $(BH)_{max}$, of the magnetic bodies after the thermal aging treatment, respectively. The values of the magnetic properties shown in these tables are those obtained when the delay time was controlled at the optimum. Table 2 also includes the values of the magnetic properties of a magnet of which the green body of the magnetic powder was prepared in a static magnetic field of 10 kOe using a hydraulic press.

TABLE 1

| | | | | | |
|---|---|---|---|---|---|
| Peak value of pulse-wise magnetic field, kOe | 10 | 20 | 30 | 40 | 50 |
| Saturation magnetization, as sintered, kG | 11.7 | 12.15 | 12.4 | 12.65 | 12.8 |

TABLE 2

| | $4\pi M_z$, kG | $B_r$, kG | ${}_iH_c$, kOe | $(BH)_{max}$, MGOe |
|---|---|---|---|---|
| 10 kOe peak value | 11.7 | 11.5 | 13.2 | 30.2 |
| 50 kOe peak value | 12.8 | 12.6 | 13.0 | 37.5 |
| 10 kOe static field | 11.6 | 11.4 | 13.0 | 29.0 |

EXAMPLE 3

The same magnetic powder of an alloy composed of samarium, cobalt, iron, copper and zirconium as used in Example 1 was shaped into green bodies by the field pressing under an impacting compressive force using the same apparatus illustrated in FIG. 1. The delay time D was varied by using three different magnetization coils No. 1, No. 2 and No. 3 having different rising times of 0.2, 1.5 and 3.2 ms, respectively. The peak value of the pulse-wise magnetic field was 20 kOe in each pressing. The peak value of the impacting compressive force was 1 ton/cm$^2$. The thus obtained green bodies of the magnetic powder were subjected to sintering in an inert atmosphere for 1 hour at a temperature in the range from 1100° to 1200° C. followed by quenching. The saturation magnetization of the thus obtained sintered bodies is shown in FIG. 5 as a function of the delay time. The slight decrease in the saturation magnetization when the rising time of the pulse-wise magnetic field was 0.2 ms is presumably due to the decrease in the effective field for particle orientation in the molding die as a consequence of the appearance of eddy current.

EXAMPLE 4

The same magnetic powder of an alloy composed of samarium, cobalt, iron, copper and zirconium as used in Example 1 was shaped into green bodies by the field pressing under an impacting compressive force using the same apparatus illustrated FIG. 1. The velocity of the dropping hammer was varied by controlling the pressure of the compressed air in the air reservoir at 1.5, 2.0 and 3.0 atmospheres so that the values of the energy for the compression molding were 12, 17 and 20 kg.m, respectively, with varied peak width of the impacting force of 8, 5 and 2 ms, respectively. The rising time of the pulse-wise magnetic field was 3 ms and the peak value of the pulse-wise magnetic field was 20 kOe with varied delay time. The thus shaped green bodies were subjected to sintering under the same conditions as in Example 3 and the saturation magnetization of the sintered bodies was measured to give the results shown in FIG. 6 as a function of the delay time.

EXAMPLE 5

A molding die placed in a 4-polar electromagnet for particle orientation as illustrated in FIG. 9 was filled with the same magnetic powder of an alloy of samarium, cobalt, iron, copper and zirconium as used in Example 1 and the magnetic powder was shaped into a green body by using the apparatus illustrated in FIG. 1. The peak value of the magnetic field at each of the magnetization poles was 20 kOe and the peak value of the impacting compressive force was 1 ton/cm$^2$. The delay time D between the peaks was 5 ms. The thus prepared green bodies of the magnetic powder were subjected to sintering in an inert atmosphere for 1 hour at a temperature in the range from 1100° to 1200° C. followed by quenching and then subjected to thermal aging by keeping them for 2 hours at 800° C. followed by gradual temperature decrease down to 400° C. at a rate of 0.5° C./minute.

The thus sintered and aged bodies were magnetized at a peak value of the magnetization field of 20 kOe by use of an electromagnet for magnetization having an inner diameter smaller by about 80% than the yoke used in the field pressing. The magnetic body under magnetization was kept unsupported to ensure mobility. The magnetic open flux around the outer periphery of the thus prepared and magnetized 4-polar, radially anisotropic permanent magnet was measured by use of a Hall IC probe to give the results illustrated by the curve I in FIG. 10. The curve II in FIG. 10 shows similar results obtained for an isotropic permanent magnet prepared in the same manner as above without magnetic field for particle orientation.

EXAMPLE 6

The procedure for the field pressing of the same magnetic powder as used in the preceding example was substantially the same in the preceding example except that the electromagnet for particle orientation used in this case was 24-polar instead of 4-polar. The subsequent sintering, aging and magnetization treatments were undertaken also in the same manner as in the preceding example. FIG. 11 shows the result of the measurement of the magnetic open flux around the outer periphery of the thus obtained 24-polar, radially anisotropic permanent magnet. FIG. 12 provides a comparison of each part of the curves of the magnetic open flux between the above described sintered permanent magnet prepared according to the inventive method (curve I) and a similar radially anisotropic plastic magnet formed of a composition composed of 70% by volume of the same magnetic powder and 30% by volume of a nylon-12 resin as the binder (curve II).

EXAMPLE 7

Green bodies of magnetic powders were prepared under the same conditions as in Example 5 using the same magnetic powder of the neodymium-based alloy as used in Example 2 and a barium ferrite powder. The green bodies of the neodymium-based alloy powder were subjected to sintering under the same conditions as in Example 2 in an atmosphere of argon and the green bodies of the ferrite powder were sintered in air for 2 hours at a temperature in the range from 1100° to 1200° C. Each of the sintered bodies was magnetized using a 4-polar electromagnet for magnetization having dimensions to fit the respective sintered bodies and the magnetic open flux around the outer periphery of the thus obtained radially anisotropic magnets was measured in the same manner as in Example 5 to give the results shown by the curve I for the neodymium-based magnet and curve II for the barium ferrite magnet in FIG. 13. FIG. 14 provides a comparison of the curves of the magnetic open flux between the above prepared radially anisotropic barium ferrite magnet (curve I) and an isotropic magnet having the same dimensions and prepared of the same barium ferrite powder (curve II).

What is claimed is:

1. A method for the preparation of an anisotropic permanent magnet by a powder of metallurgical technique which comprises the steps of:

(a) applying a magnetic field to a mass of anisotropically magnetic particles in a pulse-wise manner so as to orient the particles to have the easy magnetization axes thereof aligned in the direction of the magnetic field;

(b) applying an impacting compressive force to the mass of the thus oriented anisotropically magnetic particles in the direction substantially parallel to the direction of the pulse-wise magnetic field, the impacting compressive force being started and ended during the period in which the pulse-wise magnetic field is sustained, so as to compact the particles into a shaped green body; and (c) heating the green body into a sintered body.

2. The method as claimed in claim 1 wherein the peak value of the pulse-wise magnetic field is at least 5 kOe.

3. The method as claimed in claim 1 wherein a pulse of the pulse-wise magnetic field has a width in the range from 0.01 millisecond to 1 second.

4. The method as claimed in claim 1 wherein the rising time from the start to the peak of a pulse of the pulse-wise magnetic field is in the range from 1 microsecond to 0.5 second.

5. The method as claimed in claim 1 wherein the lasting duration of the impacting compressive force is in the range from 1 microsecond to 0.5 second.

6. A method for the preparation of a cylindrical or annular sintered anisotropic permanent magnet mangetizable in a plurality of radial directions which comprises the steps of:

(a) applying a magnetic field to a mass of anisotropically magnetic particles in a pulse-wise manner in each of the plurality of the radial directions so as to orient the particles to have the easy magnetization axes thereof aligned in the directions of the magnetic field;

(b) applying an impacting compressive force to the mass of the thus oriented anisotropically magnetic particles, the impacting compressive force being started and ended during the period in which the pulse-wise magnetic field is sustained, so as to compact the particles into a shaped green body; and (c) heating the green body into a sintered body.

7. The method as claimed in claim 6 wherein the peak value of the pulse-wise magnetic field is at least 5 kOe.

8. The method as claimed in claim 6 wherein a pulse of the pulse-wise magnetic field has a width in the range from 0.01 millisecond to 1 second.

9. The method as claimed in claim 6 wherein the rising time from the start to the peak of a pulse of the pulse-wise magnetic field is in the range from 1 microsecond to 0.5 second.

10. The method as claimed in claim 6 wherein the lasting duration of the impacting compressive force is in the range from 1 microsecond to 0.5 second.

* * * * *